US008342245B2

(12) United States Patent
Richard et al.

(10) Patent No.: US 8,342,245 B2
(45) Date of Patent: Jan. 1, 2013

(54) MULTI-POSITION VALVES FOR FRACTURING AND SAND CONTROL AND ASSOCIATED COMPLETION METHODS

(75) Inventors: Bennett M. Richard, Kingwood, TX (US); Michael H. Johnson, Katy, TX (US); Peter J. Fay, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 13/324,450

(22) Filed: Dec. 13, 2011

(65) Prior Publication Data

US 2012/0080188 A1 Apr. 5, 2012

Related U.S. Application Data

(62) Division of application No. 11/949,403, filed on Dec. 3, 2007, now Pat. No. 8,127,847.

(51) Int. Cl.

| | |
|---|---|
| ***E21B 43/00*** | (2006.01) |
| ***E21B 43/04*** | (2006.01) |
| ***E21B 43/10*** | (2006.01) |
| ***E03B 3/18*** | (2006.01) |

(52) U.S. Cl. ..... 166/296; 166/205; 166/278; 166/227; 166/381

(58) Field of Classification Search ..... 166/296, 166/205, 278, 227, 51, 381, 157
See application file for complete search history.

(56) References Cited

U.S. PATENT DOCUMENTS

| | | | | |
|---|---|---|---|---|
| 4,969,524 | A | 11/1990 | Whiteley | |
| 5,413,176 | A * | 5/1995 | Restarick | 166/277 |
| 5,875,852 | A * | 3/1999 | Floyd et al. | 166/387 |
| 5,971,070 | A | 10/1999 | Ross et al. | |
| 6,176,307 | B1 | 1/2001 | Danos et al. | |
| 6,978,840 | B2 * | 12/2005 | Henderson | 166/380 |
| 7,013,979 | B2 | 3/2006 | Richard | |
| 7,066,265 | B2 | 6/2006 | Surjaatmadja | |
| 7,185,703 | B2 | 3/2007 | Jannise et al. | |
| 7,316,274 | B2 | 1/2008 | Xu et al. | |
| 7,401,648 | B2 | 7/2008 | Richard | |
| 7,461,699 | B2 | 12/2008 | Richard et al. | |
| 7,520,335 | B2 | 4/2009 | Richard et al. | |
| 7,575,062 | B2 | 8/2009 | East, Jr. | |
| 2003/0230406 | A1 | 12/2003 | Lund | |
| 2006/0124310 | A1 | 6/2006 | Lopez de Cardenas et al. | |
| 2009/0044944 | A1 | 2/2009 | Murray et al. | |
| 2009/0078408 | A1 | 3/2009 | Richard et al. | |
| 2009/0084553 | A1 | 4/2009 | Rytlewski et al. | |

(Continued)

OTHER PUBLICATIONS

Watson, Don R., et al., "One-Trip Multistage Completion Technology for Unconventional Gas Formations", SPE 114973, Jun. 1-14, 2008.

(Continued)

*Primary Examiner* — Cathleen Hutchins
(74) *Attorney, Agent, or Firm* — Steve Rosenblatt

(57) ABSTRACT

A completion tubular is placed in position adjacent the zone or zones to be fractured and produced. It features preferably sliding sleeve valves one series of which can be put in the wide open position after run in for gravel packing and fracturing zones one at a time or in any desired order. These valves are then closed and another series of valves can be opened wide but with a screen material juxtaposed in the flow passage to selectively produce from one or more fractured zones. An annular path behind the gravel is provided by an offset screen to promote flow to the screened production port. The path can be a closed annulus that comes short of the production port or goes over it. For short runs an exterior screen or shroud is eliminated for a sliding sleeve with multiple screened ports that can be opened in tandem.

8 Claims, 7 Drawing Sheets

U.S. PATENT DOCUMENTS

| | | | |
|---|---|---|---|
| 2009/0101355 | A1 | 4/2009 | Peterson et al. |
| 2009/0223678 | A1 | 9/2009 | Richard et al. |
| 2009/0255686 | A1 | 10/2009 | Richard et al. |

OTHER PUBLICATIONS

Garfield, G., "New One-Trip Sand-Control Completion System That Eliminates Formation Damage Resulting Fom Conventional Perforating and Gravel-Packing Operations", SPE 96660, Oct. 1-5, 2005.
Lorenz, M., et al., "Advancement in Completion Technologies Proves Successful in Deepwater Frac-Pack and Horizontal Gravel-Pack Completions", SPE 103103, Sep. 1-22, 2006.
Durst, Doug G., et al., "Improved Single-Trip Multistage Completion Systems for Unconventional Gas Formations", SPE 115260, Jun. 1-14, 2008.

* cited by examiner

MULTI-POSITION VALVES FOR FRACTURING AND SAND CONTROL AND ASSOCIATED COMPLETION METHODS

PRIORITY INFORMATION

This application is a divisional of U.S. patent application Ser. No. 11/949,403, filed on Dec. 3, 2007.

FIELD OF THE INVENTION

The field of the invention relates to completion techniques involving fracturing and more particularly the ability to gravel pack and fracture discrete segments of a formation in a desired order through dedicated valved ports followed by configuring another valve for screened sand control duty to let production begin. A crossover tool and a separate run for sand control screens after the fracturing operation is not required.

BACKGROUND OF THE INVENTION

Typical completion sequences in the past involve running in an assembly of screens with a crossover tool and an isolation packer above the crossover tool. The crossover tool has a squeeze position where it eliminates a return path to allow fluid pumped down a work string and through the packer to cross over to the annulus outside the screen sections and into the formation through, for example, a cemented and perforated casing or in open hole. Alternatively, the casing could have telescoping members that are extendable into the formation and the tubular from which they extend could be cemented or not cemented. The fracture fluid, in any event, would go into the annular space outside the screens and get squeezed into the formation that is isolated by the packer above the crossover tool and another downhole packer or the bottom of the hole. When a particular portion of a zone was fractured in this manner the crossover tool would be repositioned to allow a return path, usually through the annular space above the isolation packer and outside the work string so that a gravel packing operation could then begin. In the gravel packing operation, the gravel exits the crossover tool to the annular space outside the screens. Carrier fluid goes through the screens and back into the crossover tool to get through the packer above and into the annular space outside the work string and back to the surface.

This entire procedure is repeated if another zone in the well needs to be fractured and gravel packed before it can be produced. Once a given zone was gravel packed, the production string is tagged into the packer and the zone is produced.

There are many issues with this technique and foremost among them is the rig time for running in the hole and conducting the discrete operations. Other issues relate to the erosive qualities of the gravel slurry during deposition of gravel in the gravel packing procedure. Portions of the crossover tool could wear away during the fracking operation or the subsequent gravel packing operation, if the zone was particularly long. If more than a single zone needs to be fractured and gravel packed, it means additional trips in the hole with more screens coupled to a crossover tool and an isolation packer and a repeating of the process. The order of operations using this technique was generally limited to working the hole from the bottom up. Alternatively, one trip multi-zone systems have been developed that require a large volume of proppant slurry through the crossover tool and that increases the erosion risk.

What the present invention addresses are ways to optimize the operation to reduce rig time and enhance the choices available for the sequence of locations where fracturing can occur. Furthermore, through a unique valve system, fracturing can occur in a plurality of zones in any desired order followed by operating another valve to place filter media in position of ports so that production could commence with a production string without having to run screens or a crossover tool into the well. These and other advantages of the present invention will be more readily apparent to those skilled in the art from the description of the various embodiments that are discussed below along with their associated drawings, while recognizing that the claims define the full scope of the invention.

SUMMARY OF THE INVENTION

A completion tubular is placed in position adjacent the zone or zones to be fractured and produced. It features preferably sliding sleeve valves one series of which can be put in the wide open position after run in for gravel packing and fracturing zones one at a time or in any desired order. These valves are then closed and another series of valves can be opened wide but with a screen material juxtaposed in the flow passage to selectively produce from one or more fractured zones. An annular path behind the gravel is provided by an offset screen to promote flow to the screened production port. The path can be a closed annulus that comes short of the production port or goes over it. For short runs an exterior screen or shroud is eliminated for a sliding sleeve with multiple screened ports that can be opened in tandem.

BRIEF DESCRIPTION OF THE DRAWINGS

FIG. 7 is an alternative embodiment with no external proppant shroud and instead having a sleeve to open multiple production ports with screened openings and a frac valve all shown in a closed position for run in;

DETAILED DESCRIPTION OF THE PREFERRED EMBODIMENT

Figure 1:
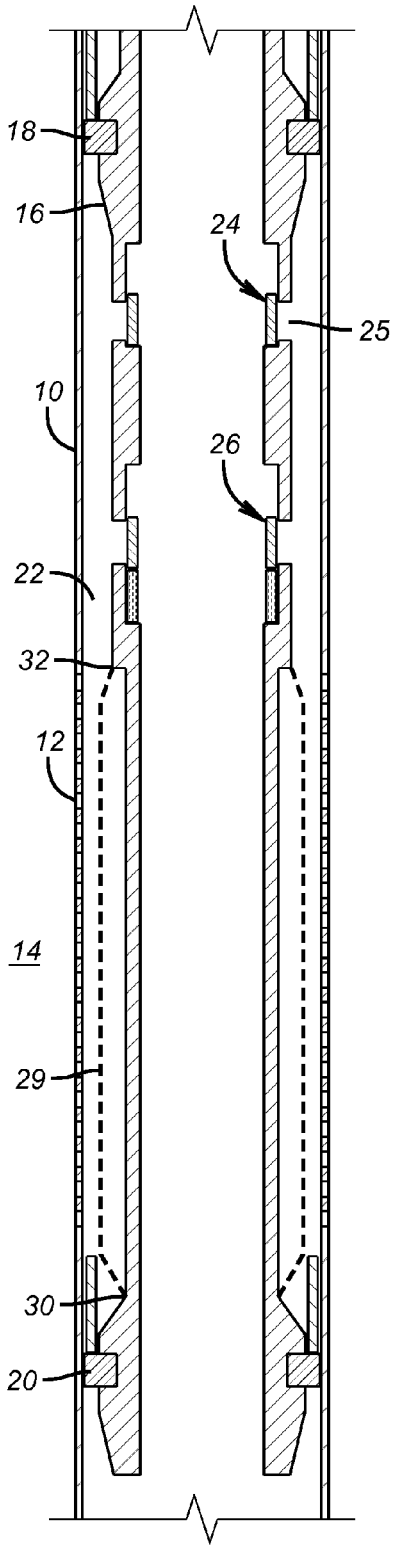
FIG. 1 is a section view of an embodiment with a proppant control shroud shown in the run in position.

FIG. 1 is a schematic illustration of a wellbore 10 that can be cased or in open hole. There are perforations 12 into a formation 14. A string 16 is shown in part if FIG. 1 to the extent it spans a production interval defined between seals or packers 18 and 20. These seal locations can be polished bores in a cased hole or any type of packer. The two barriers 18 and 20 define a production interval 22. While only one interval is shown the string 16 can pass through multiple intervals that preferably have similar equipment so that access to them can occur in any desired order and access can be to one interval at a time or multiple intervals together.

Figure 2:
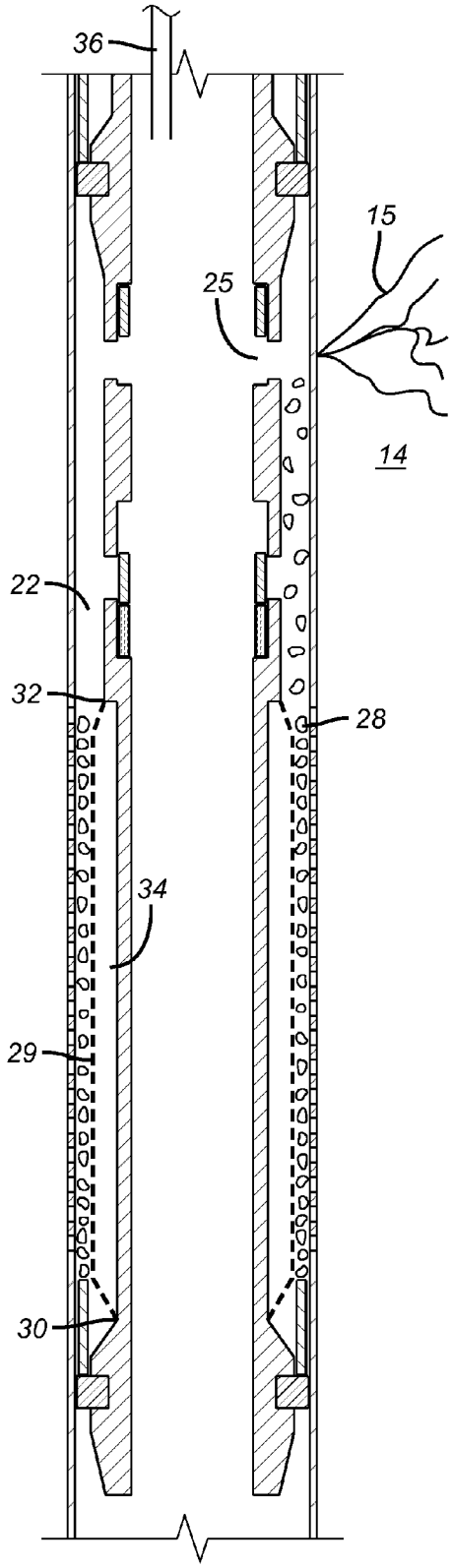
FIG. 2 is the view of FIG. 1 with a valve open for proppant deposition and fracturing.

The string 16 for the interval 22 that is illustrated has a frac valve 24 that is preferably a sliding sleeve shown in the closed position in FIG. 1 for run in. Valve 24 regulates opening or openings 25 and is used in two positions. The closed position is shown in FIG. 1 and the wide open position is shown in FIG. 2. In the FIG. 2 position, gravel slurry can be squeezed into the formation 14 leaving the gravel 28 in the annular interval 22 just outside the proppant screen or shroud 29. Shroud 29 is sealed on opposite ends 30 and 32 and in between defines an annular flow area 34. While the shroud 29 is shown as one continuous unit, it can also be segmented with discrete or interconnected segments. The proppant 28 stays in the interval 22 and the carrier fluid is pumped into the formation 14 to complete the fracturing operation. At that point the valve 24 is closed and excess proppant 28 that is still in the string 16 can be circulated out to the surface using, for example, coiled tubing 36.

At this point the production valve 26 which is preferably a sliding sleeve with a screen material 38 in or over its ports is brought into alignment with ports 40 and production from the formation 14 begins. Alternatively, the screen material 38 can be fixed to either side of the string 16. In short, the open position of production valve 26 results in the production flow being screened regardless of screen position and screen type. Flow can take a path of less resistance through the flow area 34 to reach the port 40. While such flow avoids most of the gravel pack 28 by design, the presence of passage 34 allows a greater flow to reach the ports 40 so as not to impede production. The presence of a screen material 38 at ports 40 serves to exclude solids that may have gotten into passage 34 through the coarse openings in shroud 29. The screen material 38 can be of a variety of designs such as a weave, conjoined spheres, porous sintered metal or equivalent designs that perform the function of a screen to keep gravel 28 out of the flow passage through string 16.

It should be noted that while only a single port 25 and 40 are shown that there can be multiple ports that are respectively exposed by operation of valves 24 and 26. While valves 24 and 26 are preferably longitudinally shiftable sliding sleeves that can be operated with a shifting tool, hydraulic or pneumatic pressure or a variety of motor drivers, other styles of valves can be used. For example, the valves can be a sleeve that rotates rather than shifts axially. While a single valve assembly in an interval between barriers 18 and 20 is illustrated for valves 24 and 26 and their associated ports, multiple assemblies can be used with either discrete sleeves for a given row of associated openings or longer sleeves that can service multiple rows of associated openings that are axially displaced.

Figure 3:
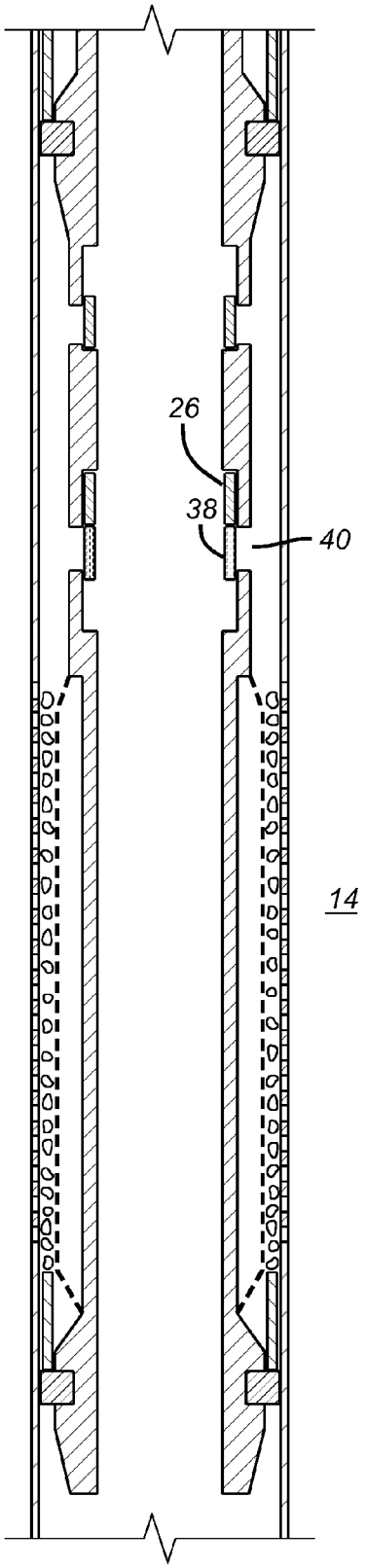
FIG. 3 is the view of FIG. 2 with the frac valve closed and the production valve open with a screen in the flow path of the production valve.
Figure 4:
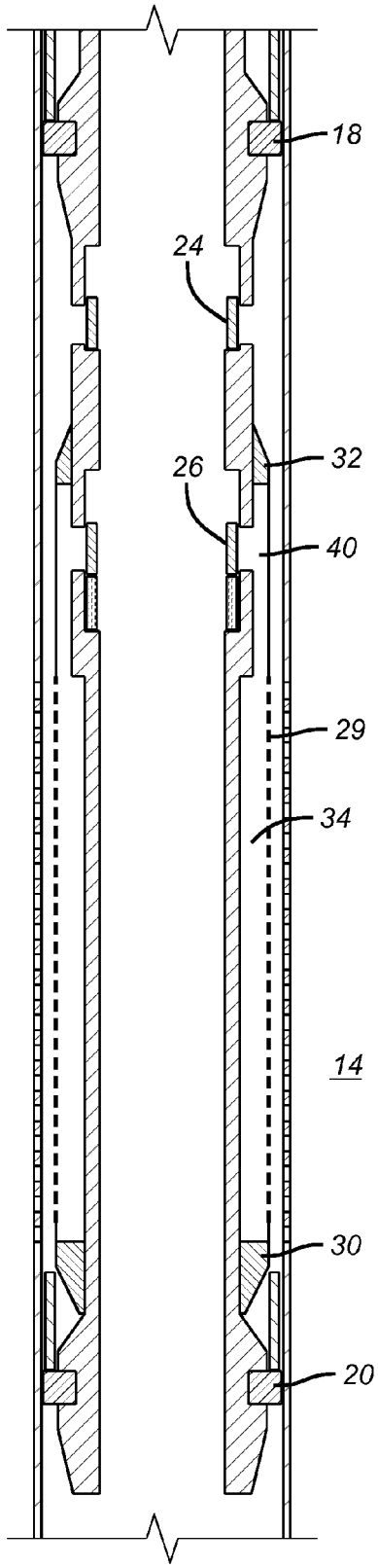
FIG. 4 is the view of FIG. 1 but with an alternative embodiment where the proppant shroud straddles the production valve.
Figure 5:
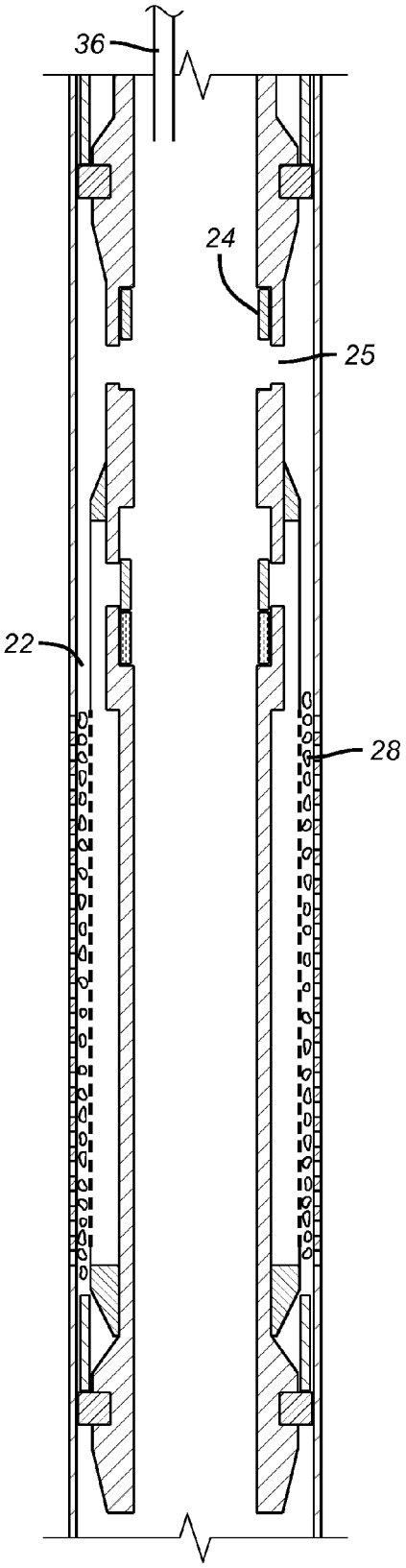
FIG. 5 is the view of FIG. 4 with the fracture and proppant deposition valve open.
Figure 6:
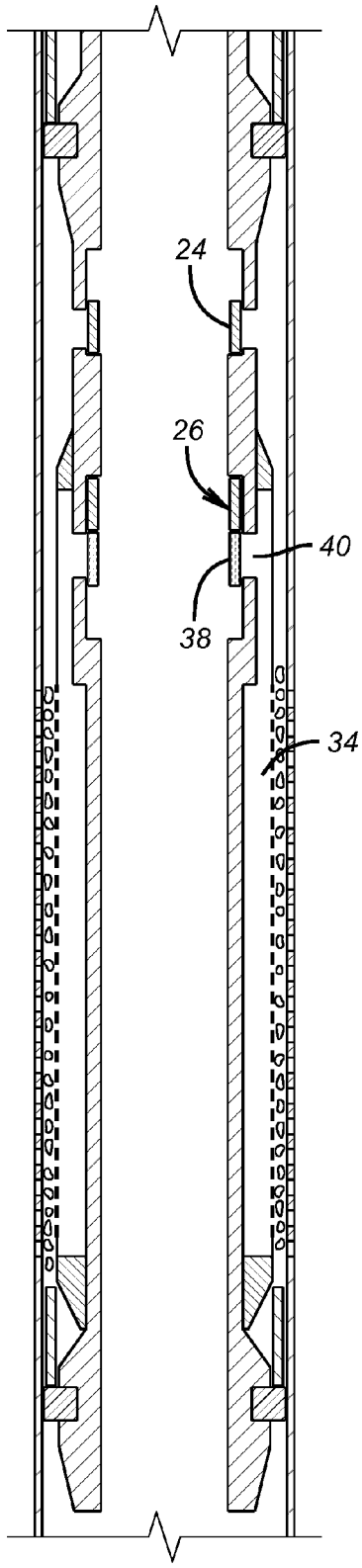
FIG. 6 is the view of FIG. 5 with the fracture and proppant deposition valve closed and the production valve open with a screen in the flow path.

FIGS. 4-6 correspond to FIGS. 1-3 with the only difference being the shroud 29 having an end 32 that is past the openings 40 so that the passage 34 goes directly to the ports 40. Here, as opposed to FIGS. 1-3, once the flow from the formation 14 passes through the shroud 29 it doesn't have to pass through that shroud 29 a second time. In all other respects the method is the same. In FIG. 4 the valves 24 and 26 are closed for run in. When the string 16 is in position and the barriers 18 and 20 are activated, the valve 24 is opened, as shown in FIG. 5, and proppant slurry 28 is delivered through ports 25. There is no crossover needed. When the proper amount of proppant is deposited in the interval 22, the valve 24 is closed and valve 26 is opened to place the screen material 38 over openings 40 to let production begin. As before, with the design of FIGS. 1-3 and the variations described for those FIGS., the same options are available to the alternative design of FIGS. 4-6. One advantage of the design in FIGS. 4-6 is that there is less resistance to flow in passage 34 because of the avoidance of going through the shroud 29 a second time to get to the ports 40. On the other hand, one of the advantages of the design of FIGS. 1-3 is that the inside dimension of the string 16 in the region close to valve 26 can be larger because the shroud 29 terminates at end 32 well below the ports 40.

In both designs the length of shroud 29 can span many pipe joints and can exceed hundreds if not thousands of feet depending on the length of the interval 22. Those skilled in the art will appreciate that short jumper sections can be used to cover the connections after assembly so that the passage 34 winds up being continuous.

Figure 7:
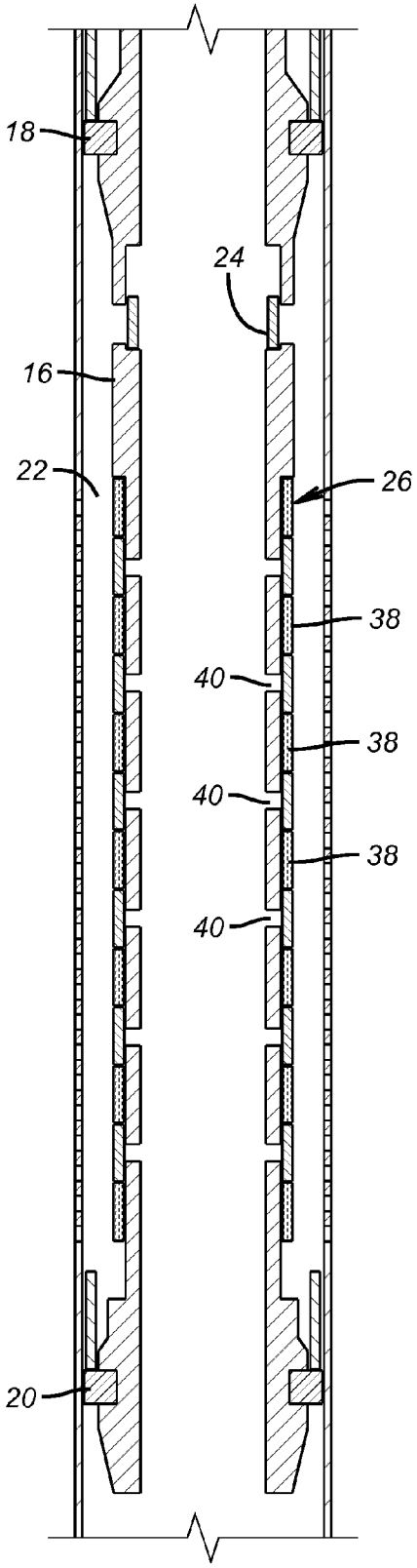
Figure 8:
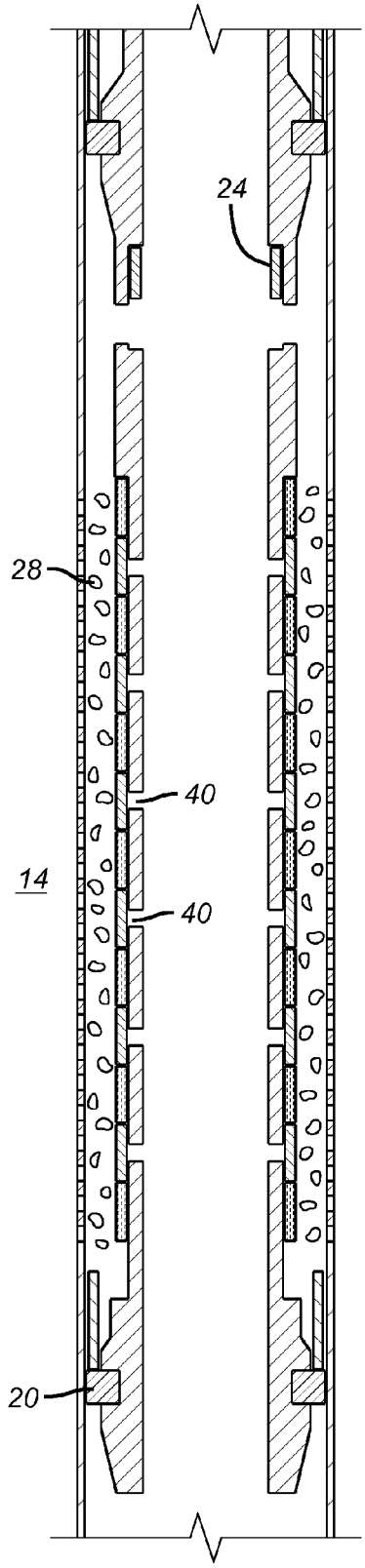
FIG. 8 is the view of FIG. 7 with the frac valve in the wide open fracturing position.
Figure 9:
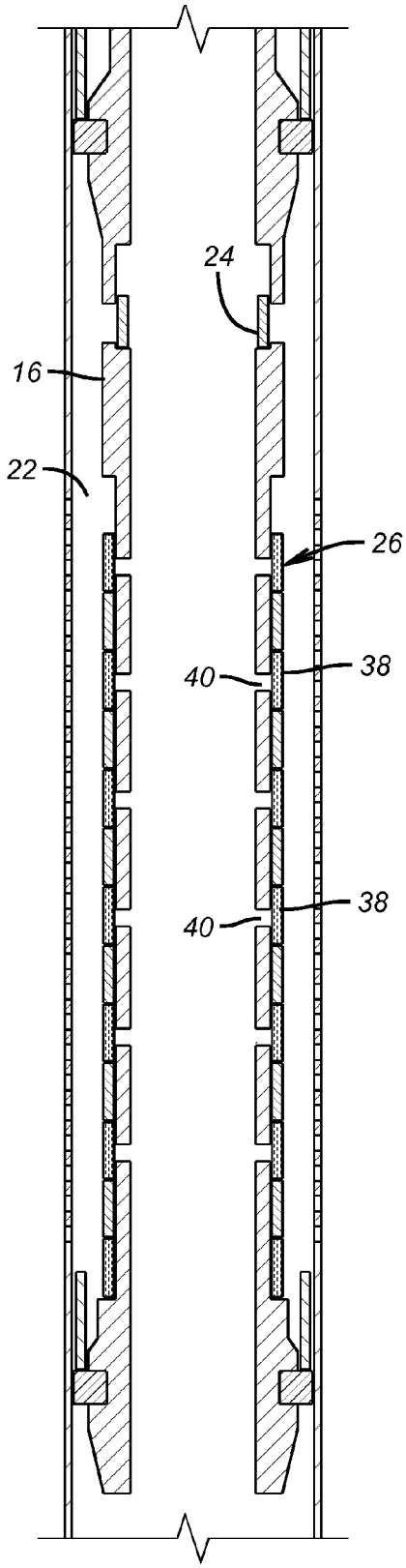
FIG. 9 is the view of FIG. 8 with the frac valve closed and the production sliding sleeve in the open position.

FIGS. 7-9 work similarly to FIGS. 1-3 with the only design difference being that the shroud 29 is not used because the application for this design is for rather short intervals where a bypass passage such as 34 around a shroud 29 is not necessary to get the desired production flow rates. Instead valve 26 has a plurality of screen sections 38 that can be aligned with axially spaced arrays of openings 40. In this case as with the other designs, the valves 24 and 26 can be located within or outside the tubular string 16. In all other ways, the operation of the embodiment of FIGS. 7-9 is the same as FIGS. 1-3. In FIG. 7 for run in the valves 24 and 26 are closed. The string 16 is placed in position and barriers 18 and 20 define the producing zone 22. In FIG. 8, the valve 24 is opened and the gravel slurry 28 is squeezed into the formation 14 leaving the gravel in the interval 22 outside of openings 40. In FIG. 9 the gravel packing and frac is completed and the valve 24 is closed. Then valve 26 is opened placing screen material 38 in front of openings 40 and production can begin. In essence, valve 26 with its screen sections 38 and openings 40 act as a screen that is blocked for run in and gravel deposition and frac and then functions as a screen for production. Again multiple assemblies of valves 24 and 26 can be used so that if one fails to operate another can be used as a backup. In the same manner if one set of screen sections 38 clog up, another section can be placed in service to continue production.

Figure 10:
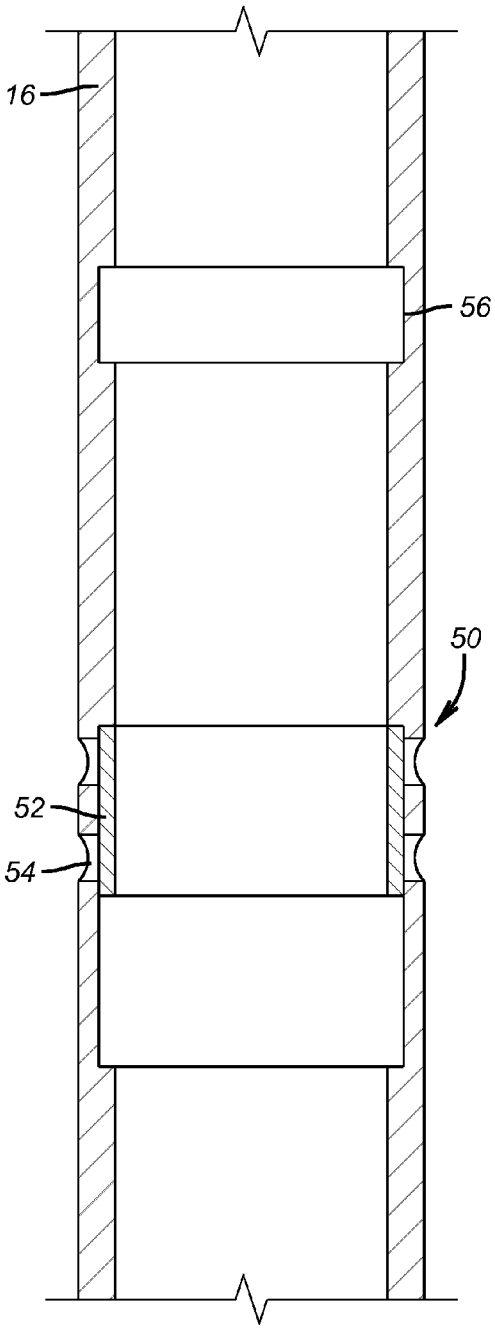
FIG. 10 is a view of a frac valve in the closed position.
Figure 11:
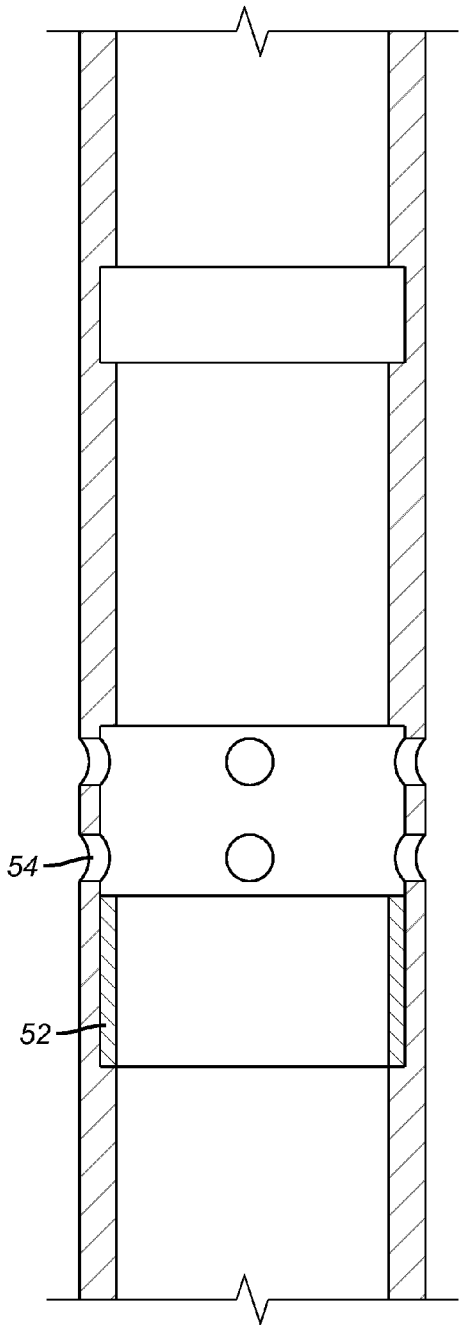
FIG. 11 is the view of FIG. 10 with the frac valve in the open position.
Figure 12:
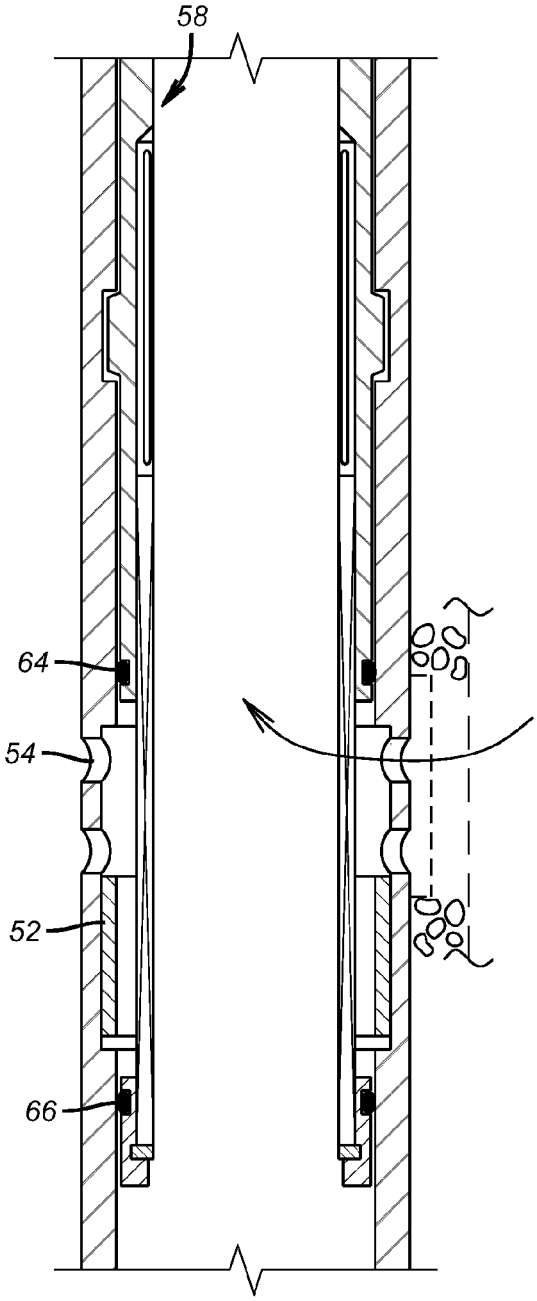
FIG. 12 is the view of FIG. 11 with the frac valve in the open position and an insertable screen in position for production.
Figure 13:
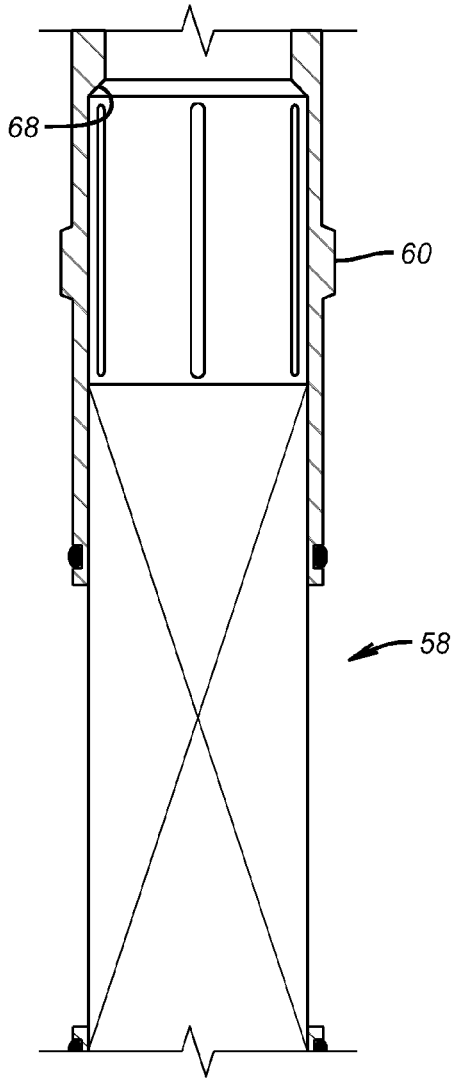
FIG. 13 is the view of the insertable screen shown in FIG. 12.

FIG. 10 illustrates a valve 50 that uses as sliding sleeve 52 to selectively cover ports 54. The ports 54 are closed in FIG. 10 and open in FIG. 11. A latch profile 56 is provided adjacent each sleeve 52. An array of valves 50 and associated ports 54 is envisioned. The configuration of the latch profile 56 is preferably unique so as to accept a specific screen assembly 58, one of which is shown in FIG. 13. Each screen assembly has a latch 60 that is uniquely matched to a profile 56. FIG. 12 shows a screen assembly 58 that has a latch 60 engaged in its mating profile 56. In that position a screen 62 has end seals 64 and 66 that straddle ports 54 with sleeve 52 disposed to uncover the ports 54. One or more such assemblies are envisioned in an interval 22 between isolators 18 and 20 in the manner described before. In operation, the ports 54 are closed for run in as shown in FIG. 10. After getting the string 16 into position and setting the barriers (not shown in FIG. 10) to define an interval 22, as before, the ports 54 are exposed and gravel slurry is forced into the formation as the formation is fractured. At this time the screen assembly 58 is not in string 16. When that step is done and the excess slurry is circulated out, the valves 50 to be used in production are opened. A screen assembly 58 with a latch 60 that matches the valve or valves 50 just opened is delivered into the string 16 and secured to its associated profile 56. In this manner, the ports 54 that are now open each receive a screen assembly 58 and production can begin. Any order of producing multiple intervals can be established. The screen sections 58 can be dropped in or lowered in on wireline or other means. They are designed to release with an upward pull so if they clog during production they can be released from latch 56 and removed and replaced to allow production to resume. The screen assemblies can have a fishing neck 68 to be used with known fishing tools to retrieve the screen section 58 to the surface. One screen section can cover one array of ports 54 or multiple arrays, depending on its length and the spacing between seals 64 and 66.

Optionally, the shroud 29 of from the other embodiments can be combined into the FIGS. 10-13 embodiment and it can be positioned to come just short of ports 54 or to straddle them as previously described and for the same reasons.

The above description is illustrative of the preferred embodiment and many modifications may be made by those skilled in the art without departing from the invention whose scope is to be determined from the literal and equivalent scope of the claims below.

We claim:

1. A completion method, comprising:

delivering a housing having at least one valved port to a desired location downhole;

performing a downhole operation through said valved port when said valved port is open;

inserting at least one open ended tubular screen into said housing after performing said downhole operation, said open ended screen allowing tools to pass therethrough;

sealingly supporting said screen to said housing while said screen covers said valved port; and taking fluids into said housing through said screen.

2. The method of claim 1, comprising:

performing a gravel pack and formation fracture as said downhole operation.

3. The method of claim 2, comprising:

providing interacting components on said housing and said screen that engage for placement of said screen over said valved port.

4. The method of claim 3, comprising:

providing a plurality of valved ports with each having a unique interacting component on said housing designed to accept a matched component on said screen for specific placement of each screen in said housing.

5. The method of claim 4, comprising:

providing unique profiles in said housing and a matching latch on each screen to specifically locate and support each said screen in said housing.

6. The method of claim 5, comprising:

isolating a plurality of producing zones around said housing where each zone has a valved port capable of accepting the inserted screen after performing said gravel pack and fracturing.

7. The method of claim 2, comprising:

providing at least one perforated shroud around said housing;

depositing gravel outside said shroud; taking production flow through a passage in said shroud to bypass some of the gravel pack before reaching said screen.

8. The method of claim 1, comprising:

performing said inserting by lowering or dropping said screen into said housing.

* * * * *